US008894248B2

(12) United States Patent
Quadri et al.

(10) Patent No.: US 8,894,248 B2
(45) Date of Patent: Nov. 25, 2014

(54) STAGE LIGHTING FIXTURE

(71) Applicant: Clay Paky S.p.A., Seriate (IT)

(72) Inventors: Pasquale Quadri, Torre De' Roveri (IT); Angelo Cavenati, Brusaporto (IT)

(73) Assignee: Clay Paky S.p.A., Seriate (IT)

( * ) Notice: Subject to any disclaimer, the term of this patent is extended or adjusted under 35 U.S.C. 154(b) by 109 days.

(21) Appl. No.: 13/767,523

(22) Filed: Feb. 14, 2013

(65) Prior Publication Data

US 2013/0223078 A1 Aug. 29, 2013

(30) Foreign Application Priority Data

Feb. 16, 2012 (IT) ..... MI2012A0231

(51) Int. Cl.
*F21V 29/02* (2006.01)
*F21V 9/04* (2006.01)
*F21W 131/406* (2006.01)

(52) U.S. Cl.
CPC ..... *F21V 29/025* (2013.01); *F21V 9/04* (2013.01); *F21W 2131/406* (2013.01); *F21V 29/02* (2013.01)
USPC ..... 362/294; 362/373

(58) Field of Classification Search
CPC . F21V 29/02; F21V 29/025; F21W 2131/406
USPC ..... 362/294, 373
See application file for complete search history.

(56) References Cited

U.S. PATENT DOCUMENTS

| | | | | |
|---|---|---|---|---|
| 4,890,208 | A | 12/1989 | Izenour | |
| 5,515,254 | A | 5/1996 | Smith et al. | |
| 8,408,755 | B2 * | 4/2013 | Quadri et al. | 362/321 |
| 2011/0080735 | A1 * | 4/2011 | Quadri et al. | 362/277 |
| 2012/0063147 | A1 * | 3/2012 | Quadri et al. | 362/296.01 |
| 2012/0155090 | A1 * | 6/2012 | Quadri et al. | 362/293 |

FOREIGN PATENT DOCUMENTS

WO WO 2011/119451 9/2011

* cited by examiner

*Primary Examiner* — Stephen F Husar
*Assistant Examiner* — James Cranson, Jr.
(74) *Attorney, Agent, or Firm* — Leason Ellis LLP

(57) ABSTRACT

A stage lighting fixture includes a casing; a light source, which is housed inside the casing and is adapted-to emit a light beam along an optical axis; a reflector coupled to the light source; light beam processing means housed inside the casing and adapted to selectively intercept the light beam; at least one heat-shield assembly located inside the casing, between the light source and the light beam processing means, to substantially divide the casing into a first area comprising the light source and the reflector, and a second area comprising the light beam processing means; the heat-shield assembly comprising a heat-shield filter, and a detector for detecting a parameter indicative of the temperature of the heat-shield filter; a cooling assembly for cooling the inside of the casing; a control device configured for regulating the cooling assembly on the basis of the parameter detected by the detector.

11 Claims, 2 Drawing Sheets

STAGE LIGHTING FIXTURE

The present invention relates to a stage lighting fixture.

BACKGROUND OF THE INVENTION

Stage lighting fixtures are known which are provided with a casing, a light source adapted to emit a light beam, a reflector coupled to the light source and at least one beam processing element (such as a dichroic filter, a gobo disc, a dimmer), adapted to selectively intercept the light beam for processing it.

A heat-shield filter is arranged between the light source and the beam processing elements, which divides the casing substantially into a first area comprising the light source and into a second area comprising the light beam processing elements.

A lighting fixture of this type is described for example in documents U.S. Pat. No. 4,890,208 and U.S. Pat. No. 5,515,254.

The area comprising the light source is characterized by high temperatures and is generally cooled by means of a cooling assembly comprising at least one fan arranged in the proximity of an air outlet for aiding the circulation of cold air coming from outside the casing.

The heat-shield filter is substantially configured so as to produce a heat barrier between the area in which the light source is housed and the area in which the beam processing means are housed. In detail, the heat-shield filter is configured so as to filter the hot radiations (radiations which cause an increase in the temperature of the body on which they impinge) in the field of non visible radiations. This prevents the hot radiations in the field of non visible radiations from impinging on the light beam processing means (dichroic filters, gobo assemblies, dimmers), thereby heating them.

However, in the lighting fixtures of this type it often happens that the heat-shield filter becomes excessively overheated. In fact, the hot radiations produced by the light source and the hot radiations in the field of visible radiations reflected by the light beam processing means (for example, by the dichroic filters, by the dimmer) impinge on the heat-shield filter.

The overheating of the heat-shield filter contributes to increasing the temperature of the area comprising the light source and in particular, of the light source bulb portion proximal to the heat-shield filter. Such phenomenon causes an uncontrolled overheating of the light source which, most of the times, causes irreversible damage to the light source.

This implies the unreliability of the lighting fixture and obvious inconveniences for the end user.

SUMMARY OF THE INVENTION

Therefore, it is an object of the present invention to provide a stage lighting fixture free from the above-described drawbacks of the prior art. In particular, it is an object of the present invention to provide a reliable lighting fixture capable of ensuring a suitable duration of the light source.

According to such objects, the present invention relates to a stage lighting fixture according to claim 1.

BRIEF DESCRIPTION OF THE DRAWINGS

Further features and advantages of the present invention will appear clearly from the following description of a non-limiting embodiment example thereof, made with reference to the figures in the accompanying drawings, in which.

DETAILED DESCRIPTION OF THE INVENTION

Figure 1:
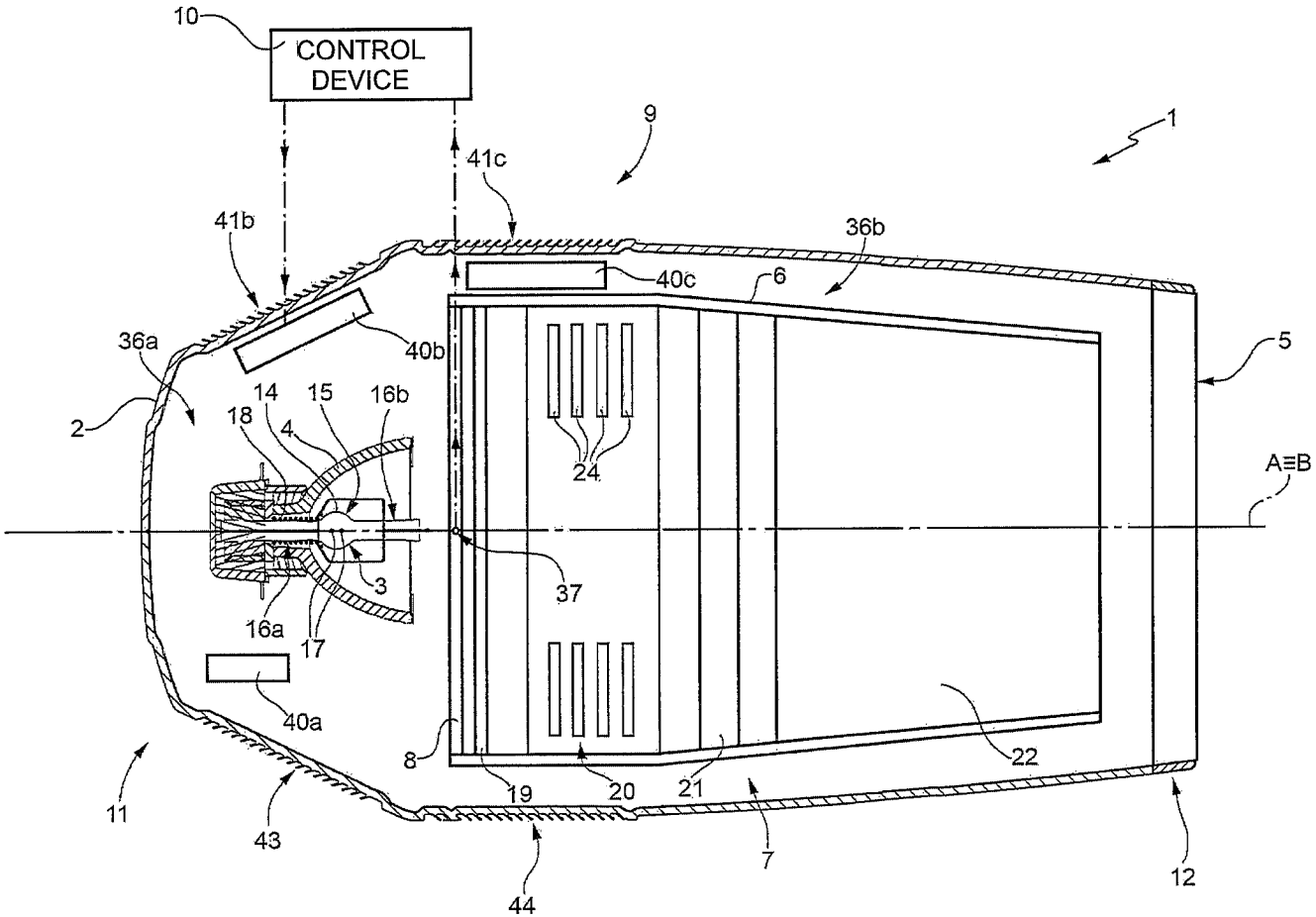
FIG. 1 shows a schematic view of a stage lighting fixture according to the present invention.

In FIG. 1, reference numeral 1 indicates a stage lighting fixture comprising a casing 2, a light source 3, a reflector 4, a lens 5, a framework 6 coupled to casing 2, beam processing means 7 (schematically shown in FIG. 1), a heat-shield assembly 8 (schematically shown in FIG. 1), a cooling assembly 9 and a control device 10.

Casing 2 extends along a longitudinal axis A and has a closed end 11 and an open end 12 opposite to the closed end 11 along axis A. Preferably, casing 2 is supported by supporting means (not shown for simplicity in the accompanying figures). In particular, the supporting means and casing 2 are configured for allowing casing 2 to rotate around two orthogonal axes, commonly referred to as PAN and TILT.

Framework 6 consists of elements coupled to each other and configured for defining a supporting structure for the elements housed inside casing 2 such as the light source 3, reflector 4, the light beam processing means 7, the heat-shield assembly 8 and the cooling assembly 9.

The light source 3 is housed inside casing 2 at the closed end 11 of casing 2, is supported by framework 6 and is adapted to emit a light beam substantially along an optical axis B.

In the non-limiting example described and illustrated herein, the optical axis B coincides with the longitudinal axis A of casing 2.

The light source 3 preferably is a discharge lamp comprising a bulb 14, generally made of glass or quartz, containing halides.

Bulb 14 comprises a center portion 15, substantially spherical, and two side portions 16*a* and 16*b*, which are substantially tubular, preferably but not necessarily with rectangular or circular section. The side portions 16*a* and 16*b* are substantially identical and the dimensions of the section of the side portions 16*a* and 16*b* substantially depend on the power of the lamp. Two electrodes 17 connected to a power circuit 18 (partially shown in the accompanying figures) are housed in the center portion 15.

The light beam is emitted substantially at the center portion 15 of bulb 14, while the side portions 16*a* and 16*b* do not emit light and are arranged in the shadow cone of the light source 3.

In the non-limiting example described and illustrated herein, the light source 3 is a metal iodide lamp.

Reflector 4 preferably is an elliptical reflector and is coupled to the light source 3.

Lens 5 is arranged at the open end 12 of casing 2. A variant not shown of the present invention envisions that lens 5 is a Fresnel lens (the case of a "wash" lighting fixture).

The light beam processing means 7 are supported by framework 6 and are configured for processing the light beam produced by the light source 3 so as to obtain particular effects.

In particular, the light beam processing means 7 comprise, preferably in a sequence, at least one dimmer 19, a color assembly 20, a gobo assembly 21 and a zoom device 22. It is understood that the light beam processing means 7 may comprise further beam processing means not described herein.

In particular, the color assembly 20 comprises a plurality of pairs of dichroic filters 24 (schematically shown in FIG. 1) adapted to selectively intercept the light beam for coloring it.

The dichroic filters 24 are arranged in a sequence along the optical axis B of the light beam and are configured for transmitting light radiations having predetermined wavelengths and for reflecting light radiations having different wavelengths.

The beam projected by the lighting fixture 1 will thus have a predetermined color, depending on the wavelengths of the light radiations that are not reflected by the dichroic filter 24 that intercepts the beam.

In detail, the dichroic filters 24 comprise a glass substrate on which a sequence of layers of dielectric material is deposited. Hence, each dichroic filter 24 differs from the adjacent dichroic filter 24 by the number and thickness of the layers of dielectric material deposited on the glass substrate.

In the non-limiting example described and illustrated herein, the color assembly 20 comprises four pairs of dichroic filters 24 (cyan, magenta, yellow, orange).

Figure 2:
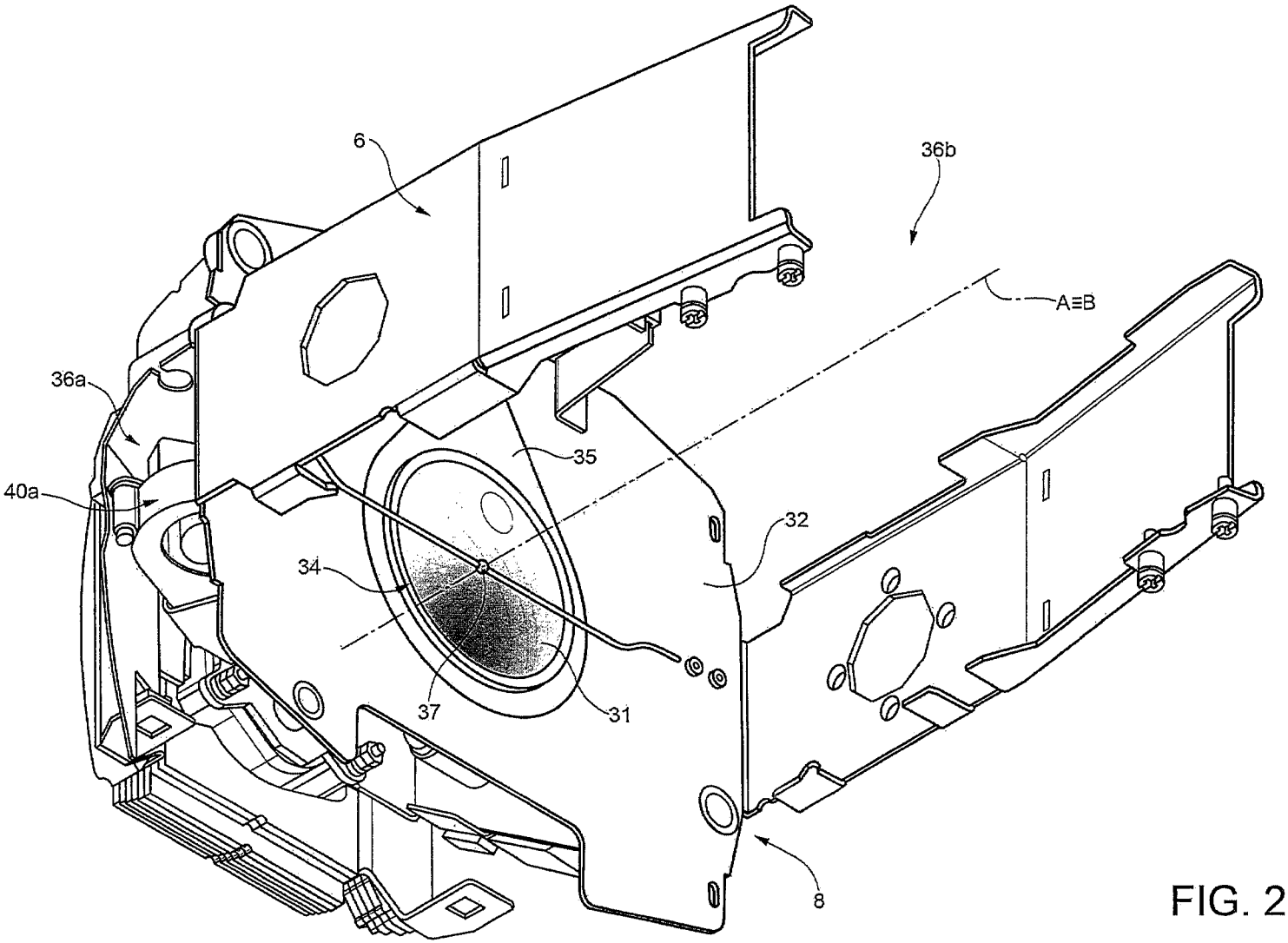
FIG. 2 shows a perspective view of a detail of the lighting fixture of FIG. 1.

With reference to FIG. 2, the heat-shield assembly 8 comprises a heat-shield filter 31 and a frame 32 provided with a center hole 34 for the passage of the light beam. Frame 32 is coupled to framework 6 and is configured for supporting the heat-shield filter 31 so that the heat-shield filter 31 is arranged at the center hole 34.

Preferably, the heat-shield filter 31 is provided with a frame 35, which is coupled to the edge of the heat-shield filter 31 and to frame 32.

The heat-shield assembly 8 is substantially configured so as to produce a heat barrier between area 36*a* in which the light source 3 is housed and area 36*b* in which the beam processing means 7 are housed.

The heat-shield filter 31 is configured for filtering the hot radiations (radiations that cause an increase in the temperature of the body on which they impinge) in the field of non visible radiations which come from the area in which the light source 3 is provided. In this way, the hot radiations in the field of non visible radiations produced by the light source 3 and by reflector 4 are prevented from impinging on the light beam processing means 7.

The heat-shield filter 31 is provided with a sensor 37 configured for detecting a parameter indicative of the temperature of the heat-shield filter 31. The indicative parameter detected by sensor 37 is fed to the control device 10 which, as will be seen in detail hereinafter, regulates the cooling assembly 9 on the basis of the parameter detected by sensor 37.

In particular, sensor 37 is configured for detecting the temperature of the heat-shield filter 31.

Sensor 37 is preferably arranged so that the temperature detection point is arranged in the proximity of the center of the heat-shield filter 31.

In fact, the center area of the heat-shield filter 31 is arranged in the proximity of portion 16*b* of bulb 14 and therefore, the overheating of the center area of the heat-shield filter 31 may cause a dangerous increase in the temperature of portion 16*b* of bulb 14 of the light source 3.

Sensor 37 preferably is a thermocouple consisting of a pair of electrical conductors of different material (preferably chromium/aluminum) connected to each other at a junction point, generally referred to as hot point and corresponding to the temperature measurement point. Preferably, the junction point is arranged at the center of the heat-shield filter 31. The opposite end of each conductor is conventionally referred to as cold joint and is connected to a control board (not shown in the accompanying figures), which feeds the detected temperature data to the control device 10.

With reference to FIG. 1, the cooling assembly 9 comprises a plurality of cooling fans 40 (schematically shown in FIG. 1) variously arranged inside casing 2.

In detail, each cooling fan 40 is arranged in the proximity of a respective air outlet 41 (not all of them are visible in the accompanying figures) obtained in casing 2.

In the non-limiting example described and illustrated herein, the cooling assembly 9 comprises a fan 40*a*, a fan 40*b* and a fan 40*c*.

Fan 40*a* is arranged on the side of the light source 3 so as to convey the air drawn from the respective air outlet (not shown in the accompanying figures as it is arranged on a portion of the casing which is not shown) and direct it into the area of casing 2 comprised between end 11 of casing 2 and the outer portion of reflector 4. In this way, fan 40*a* aids cooling of the light source 3 and of reflector 4.

Fan 40*b* is arranged above the light source 3 at a respective air outlet 41*b*. Fan 40*b* is arranged so as to convey the air drawn from the air outlet 41*b* into the area comprised between the light source 3 and the heat-shield assembly 8 so as to cool the heat-shield assembly 8. Preferably, casing 2 is provided with a further air outlet 43, arranged on the opposite side of the air outlet 41*b* with respect to axis A. Such air outlet 43 aids the escape of the airflow produced by fan 40*b* and thereby, it aids the cooling air change optimizing the cooling effect thereof.

Fan 40*c* is arranged substantially above at least a part of the light beam processing means 7, at an air outlet 41*c*.

In particular, in the non-limiting example described and illustrated herein, fan 40*c* is arranged above dimmer 19 and above the color assembly 20 for cooling them. Preferably, casing 2 is provided with an air outlet 44 arranged on the opposite side of the air outlet 41*c* with respect to axis A for aiding the circulation of the cooling flow and optimizing the cooling effect thereof.

In the non-limiting example described and illustrated herein, fan 40*a* and fan 40*c* are operated at a fixed rotation speed while fan 40*b* is operated at a variable speed under the control of the control device 10.

A variant not shown of the present invention provides for the control device to regulate also the supply of fans 40*a* and 40*c* of the cooling assembly 9 on the basis of the temperature detected by sensor 37.

The control device 10 is configured for changing the rotation speed of fan 40*b* on the basis of the parameter detected by sensor 37 of the heat-shield assembly 8.

In particular, the control device 10 is configured so as to increase the rotation speed of fan 40*b* if the parameter detected by sensor 37 exceeds a predetermined threshold value.

In the non-limiting example described and illustrated herein, the threshold value corresponds to a temperature value increased by 20/30% with respect to an acceptable value. The acceptable value varies according to the type of light source 3 used. For a light source 3 of 800 W, the temperature acceptance value is around about 200° C. and the threshold value corresponds to about 250° C.

Preferably, the control device 10 is configured to stepwise increase the rotation speed of fan 40*b* from a base value to a predetermined nominal value.

In the non-limiting example described and illustrated herein, when the parameter detected by sensor 37 exceeds the threshold value, the speed of fan 40*b* changes from a value of about 2500 revolutions per minute to a value of about 2800 revolutions per minute.

Preferably, the increase in the rotation speed of fan 40*b* is obtained by changing the supply voltage of fan 40*b*. In the non-limiting example described and illustrated herein, when the parameter value detected by sensor 37 exceeds the threshold value, the control device 10 changes the supply voltage of fan 40*b* from about 21 V to about 24 V.

Accordingly, the control system 10 causes an increase or a decrease in the rotation speed of fan 40*b* by regulating the supply voltage of fan 40*b*. The supply voltage is regulated on the basis of the parameter detected by sensor 37.

Advantageously, the lighting fixture 1 according to the present invention is configured so as to prevent an excessive overheating of the light source 3.

In fact, increasing the speed of fan 40*b* compensates the increase in the temperature of the heat-shield filter 31 and minimizes the risk of overheating of bulb 14 of the light source 3.

In fact, according to the present invention, when the temperature of the heat-shield filter 31 exceeds a critical value that may cause overheating of bulb 14 of the light source 3, the control device 10 operates by regulating the cooling assembly 9 so as to aid cooling of the light source 3 and of the heat-shield filter 31.

In this way, the entirety and the protection of bulb 14 and the reliability of the lighting fixture 1 are ensured.

Advantageously, sensor 37 is configured for detecting a parameter correlated to the temperature of the heat-shield filter 31 portion proximal to the side portion 16*b* where the electrical contacts for powering electrodes 17 are housed.

The controlled operation of fan 40*b* on the basis of the temperature of the heat-shield filter 31 allows the overheating of the contacts and the breakage of the light source 3 to be prevented.

Moreover, the provision of sensor 37 has no effect on the quality of the beam projected by the lighting fixture 1. In fact, sensor 37 is arranged in a grey area of the light source 3 and is sized so as not to cause any loss in the radiations useful for projecting the beam (conductors having a diameter of about 0.5 mm).

Finally, it is clear that changes and variations may be made to the lighting fixture described herein without departing from the scope of the appended claims.

The invention claimed is:

1. A stage lighting fixture comprising:

a casing (2);

a light source (3) which is housed inside the casing (2) at a first end (11) of the casing (2) and is adapted to emit a light beam along an optical axis (B);

a reflector (4) coupled to the light source (3);

light beam processing means (7) housed inside the casing (2) and adapted to selectively intercept the light beam;

at least one heat-shield assembly (8) located inside the casing (2), between the light source (3) and the light beam processing means (7), to substantially divide the casing (2) into a first area (36*a*) comprising the light source (3) and the reflector (4), and a second area (36*b*) comprising the light beam processing means (7); the heat-shield assembly (8) comprising a heat-shield filter (31), and a detector (37) for detecting a parameter indicative of the temperature of the heat-shield filter (31);

a cooling assembly (9) for cooling the inside of the casing (2);

a control device (10) configured for regulating the cooling assembly (9) on the basis of the parameter detected by the detector (37).

2. A lighting fixture according to claim 1, wherein the detector (37) is configured for detecting a parameter indicative of the temperature of a center portion of the heat-shield filter (31).

3. A lighting fixture according to claim 1, wherein the detector (37) is a temperature sensor thermally coupled to the heat-shield filter (31).

4. A lighting fixture according to claim 3, wherein the detector (37) comprises a thermocouple.

5. A lighting fixture according to claim 1, wherein the detector (37) is located substantially at the center of the heat-shield filter (31).

6. A lighting fixture according to claim 1, wherein the cooling assembly (9) comprises at least a first fan (40*a*, 40*b*, 40*c*); the control device (10) being configured for regulating the rotation speed of at least the first fan (40*a*, 40*b*, 40*c*) of the cooling assembly (9) on the basis of the parameter detected by the detector (37).

7. A lighting fixture according to claim 6, wherein the control device (10) is configured for increasing the rotation speed of at least the first fan (40*a*, 40*b*, 40*c*) when the parameter indicative of the temperature of the heat-shield filter (31) exceeds a threshold value.

8. A lighting fixture according to claim 7, wherein the threshold value corresponds to a temperature value increased by 20/30% with respect to an acceptable value.

9. A lighting fixture according to claim 7, wherein the control device (10) is configured to stepwise increase the rotation speed of the first fan (40*a*, 40*b*, 40*c*) from a base value to a predetermined nominal value.

10. A lighting fixture according to claim 6, wherein the control device (10) is configured for regulating the power to the first fan (40*a*, 40*b*, 40*c*) so as to cause a change in the rotation speed of the first fan (40*a*, 40*b*, 40*c*).

11. A lighting fixture according to claim 6, wherein the first fan (40*b*, 40*c*) is so located as to produce an airflow adapted to aid cooling of the heat-shield filter (31).

* * * * *